US006042393A

United States Patent [19]

Long

[11] Patent Number: 6,042,393

[45] Date of Patent: Mar. 28, 2000

[54] SUPPORT FOR COMPLIANT PIN TERMINALS

[75] Inventor: Michael D. Long, Harrisburg, Pa.

[73] Assignee: The Whitaker Corporation, Wilmington, Del.

[21] Appl. No.: 09/086,733

[22] Filed: May 29, 1998

[51] Int. Cl.[7] ..... H01R 9/09

[52] U.S. Cl. ..... 439/79; 439/676

[58] Field of Search ..... 439/79, 676, 541.5

[56] References Cited

U.S. PATENT DOCUMENTS 5,419,720 5/1995 Chen ..... 439/676
5,531,612 7/1996 Goodall et al. ..... 439/541.5
5,547,405 8/1996 Pinney et al. ..... 439/676
5,562,507 10/1996 Kan ..... 439/79
5,599,209 2/1997 Belopolsky ..... 439/676

*Primary Examiner*—Steven L. Stephan
*Assistant Examiner*—T C Patel
*Attorney, Agent, or Firm*—Robert Kapalka

[57] ABSTRACT

An insert subassembly for an electrical connector includes a lower terminal insert and an upper terminal insert. The lower terminal insert includes a lower insulative member which carries a plurality of terminals which have exposed portions at a rear of the lower insulative member. The exposed portions extend downwardly to provide leads for the connector. The upper terminal insert includes an upper insulative member having support surfaces which confront the exposed portions of the terminals of the lower terminal insert to provide support for the exposed portions when the leads are engaged with a circuit board.

5 Claims, 7 Drawing Sheets

SUPPORT FOR COMPLIANT PIN TERMINALS

FIELD OF THE INVENTION

The invention relates to terminal inserts for an electrical connector wherein the inserts include terminals with compliant pins which are insertable into holes in a circuit board.

BACKGROUND OF THE INVENTION

U.S. Pat. No. 5,531,612 discloses an electrical connector of a type known as a stacked modular jack which comprises a plurality of modular jacks that are arranged in two rows in one unit. Each of the modular jacks comprises an insert which includes terminals carried by a plastic member. Each of the terminals has a circuit board engaging portion in the form of a lead that can be inserted into a through-hole in a circuit board for electrical attachment to the circuit board by soldering. It is now proposed to provide a stacked modular jack with leads in the form of compliant pins which are interference fitted in the through-holes for retention of the leads to the circuit board without soldering. A problem with compliant pin leads is that they must be urged into their respective through-holes with a force which may cause buckling of the terminals in the vicinity of the compliant pins. Therefore, the terminals must be robust to resist buckling and/or the terminals must be firmly supported to prevent buckling. In the aforementioned patent, the terminals are substantially surrounded by plastic adjacent to the compliant pin leads. In order to reduce the size and cost of a stacked modular jack insert, it would be desirable to reduce the amount of plastic used in the insert by having the terminals exposed at a back of the insert. However, this causes a problem in that the terminals are not fully supported at the back of the insert, and terminals having compliant pin leads may be subject to buckling. The invention solves this problem by providing support for terminals which have exposed portions at a rear of a terminal insert.

SUMMARY OF THE INVENTION

The invention is an insert subassembly for an electrical connector comprising a lower terminal insert including a lower insulative member which carries a plurality of terminals which have exposed portions at a rear of the lower insulative member, the exposed portions extending downwardly to define leads for the connector, and an upper terminal insert including an upper insulative member having support surfaces which confront the exposed portions of the terminals of the lower terminal insert to provide support for the exposed portions when the leads are engaged with a circuit board.

According to one aspect of the invention, the upper insulative member includes forwardly extending ribs, and the support surfaces are at least partially defined by front surfaces of the forwardly extending ribs.

According to another aspect of the invention, the upper insulative member includes forwardly extending projections, and the support surfaces are at least partially defined by undersurfaces of the forwardly extending projections.

According to another aspect of the invention, the upper insulative member includes grooves between forwardly extending ribs, and the support surfaces are at least partially defined by a wall surface within each of the grooves.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
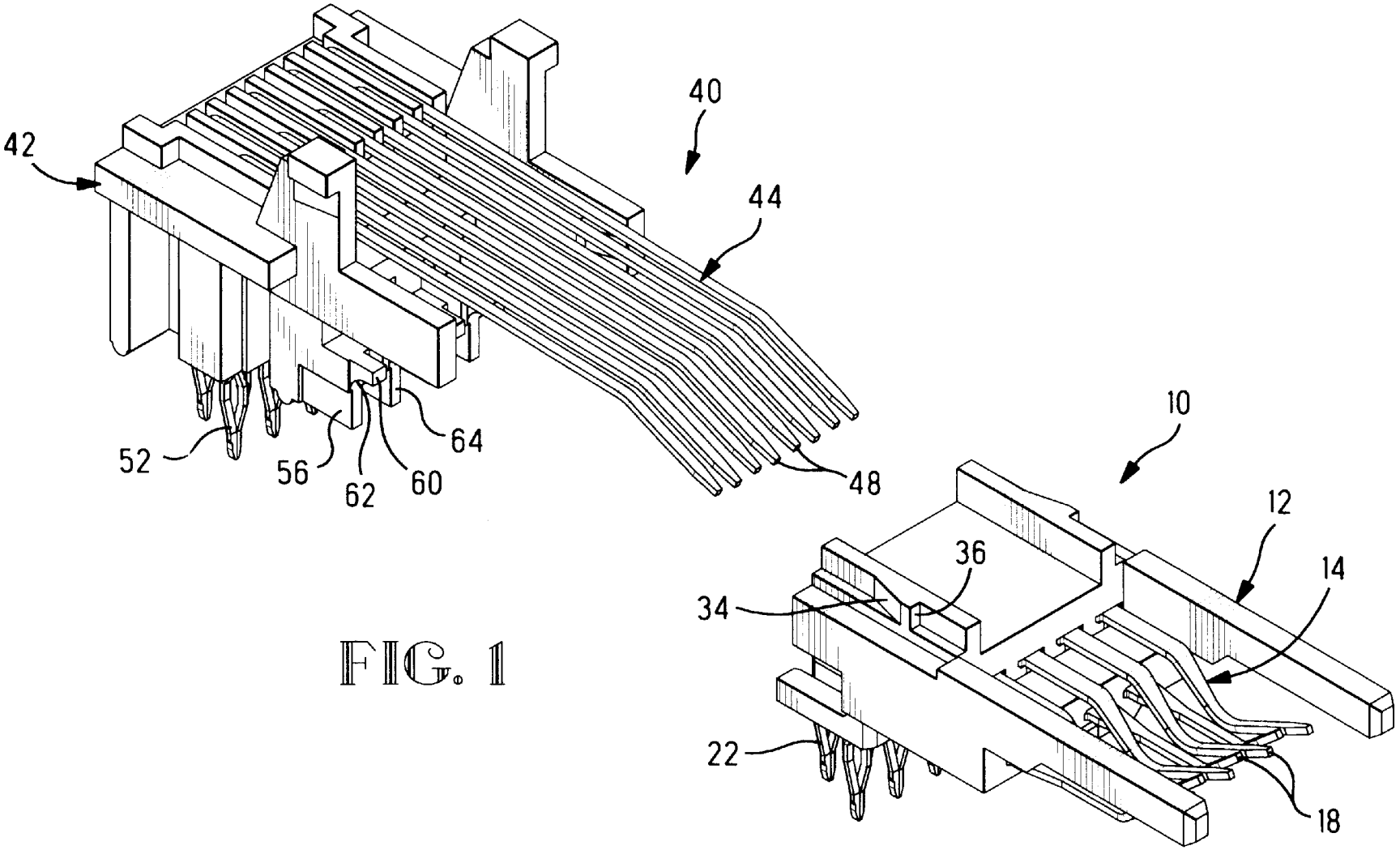
FIG. 1 is a top front isometric view of upper and lower terminal inserts which comprise a terminal insert subassembly according to the invention.
Figure 2:
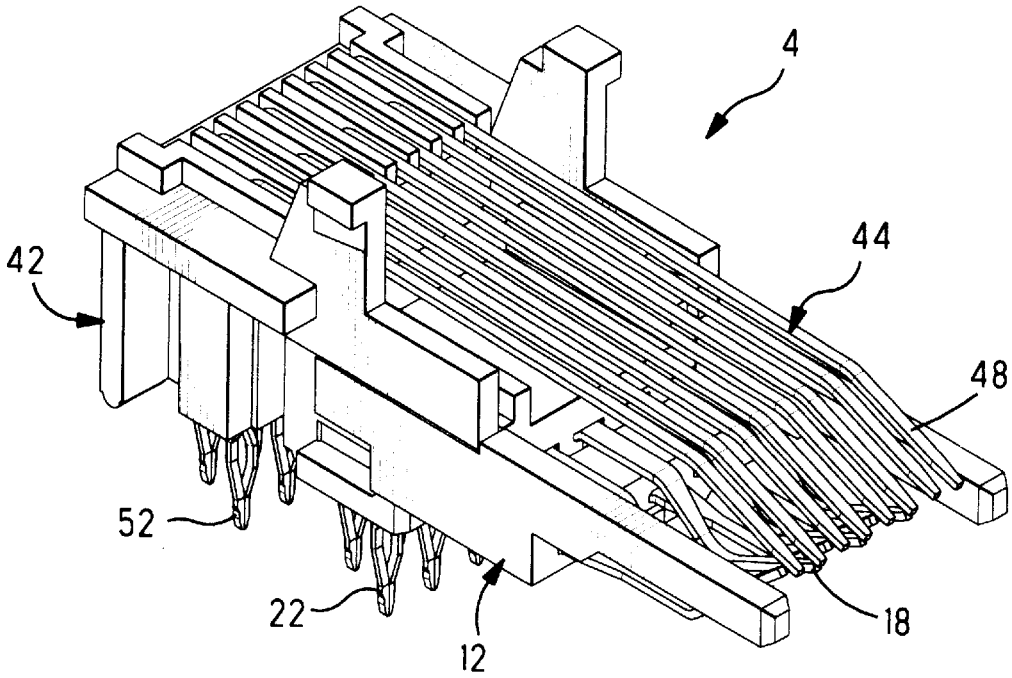
FIG. 2 is a top front isometric view of the terminal insert subassembly in assembled condition.
Figure 4:
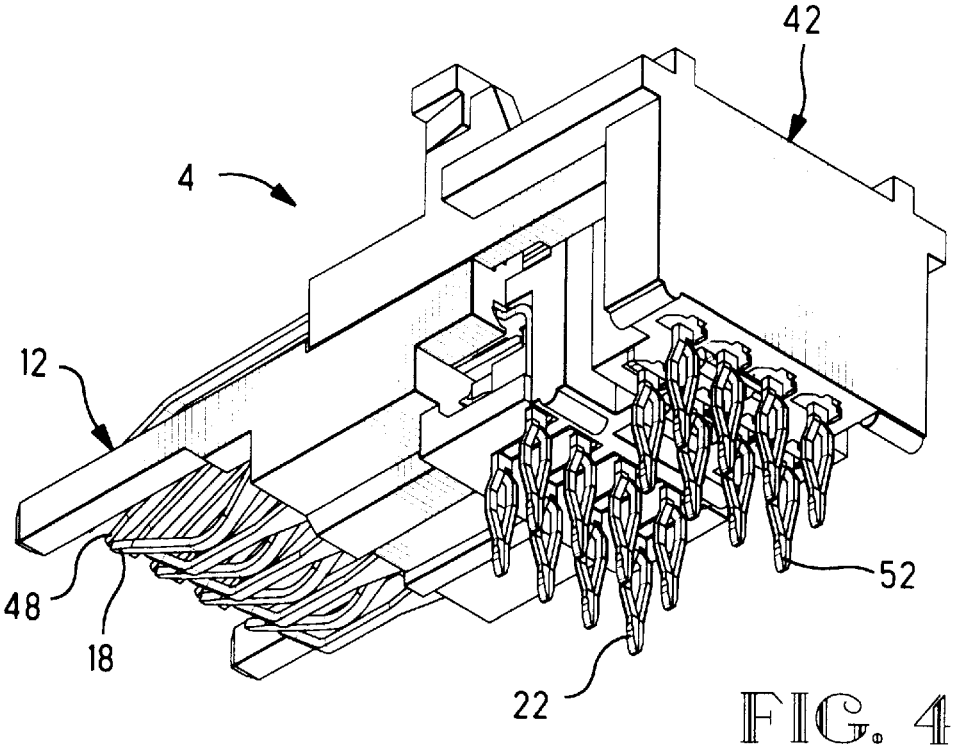
FIG. 4 is a bottom rear isometric view of the terminal insert subassembly.
Figure 3:
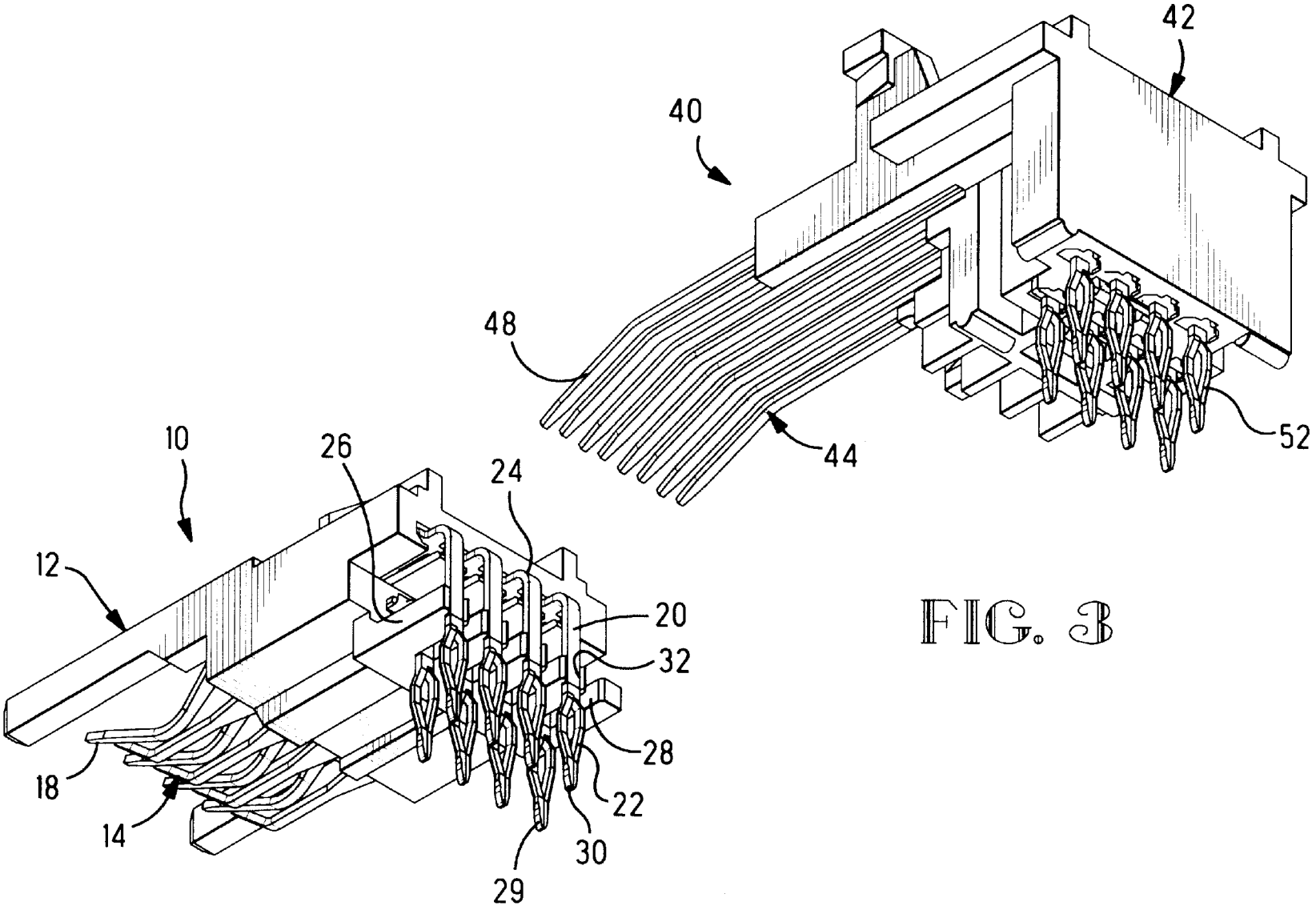
FIG. 3 is a bottom rear isometric view of the upper and lower terminal inserts.

There is shown in FIGS. 2 and 4 a terminal insert subassembly 4 which is adapted for use in an electrical connector of a type known as a stacked modular jack such as is disclosed in U.S. Pat. No. 5,531,612 which is incorporated by reference as if set forth fully herein. As shown in the '612 patent, the stacked modular jack comprises a housing having a plurality of modular jack receptacles each of which can receive a mating modular plug. The receptacles are arranged in two rows which can be termed an upper row and a lower row. Extending into each of the receptacles is an array of terminals that are arranged in accordance with an industry standard configuration such as for an RJ11 or RJ45 style modular jack. Each terminal array is separately formed as a terminal insert which can be installed in the housing. Each terminal insert includes an insulative member which holds a plurality of terminals in the fixed array. The terminal inserts are either upper terminal inserts or lower terminal inserts which correspond to the upper and lower receptacles, respectively. The terminal insert subassembly 4 comprises a lower terminal insert 10 and an upper terminal insert 40, as shown in FIGS. 1 and 3.

The lower terminal insert 10 includes a lower insulative member 12 and a plurality of terminals 14. Each of the terminals has a horizontally extending retention section 16 (shown in FIGS. 11 and 12) which is secured in the lower insulative member, a forward mating section 18 which is engageable with a terminal of a mating modular plug, and a downward section 20 which terminates in a compliant pin lead 22 that is resiliently insertable in a through-hole in a circuit board (not shown) for electrical and mechanical engagement with the circuit board. A bend section 24 transitions between the retention section 16 and the downward section 20. Exposed portions of the terminals at the rear of the lower insulative member include the downward sections 20 and the bend sections 24. The exposed portions are defined by a lack of insulative material on at least one side of the terminals. The absence of material surrounding the terminals at the rear of the lower insulative member minimizes the size and cost of the lower insulative member.

Figure 5:
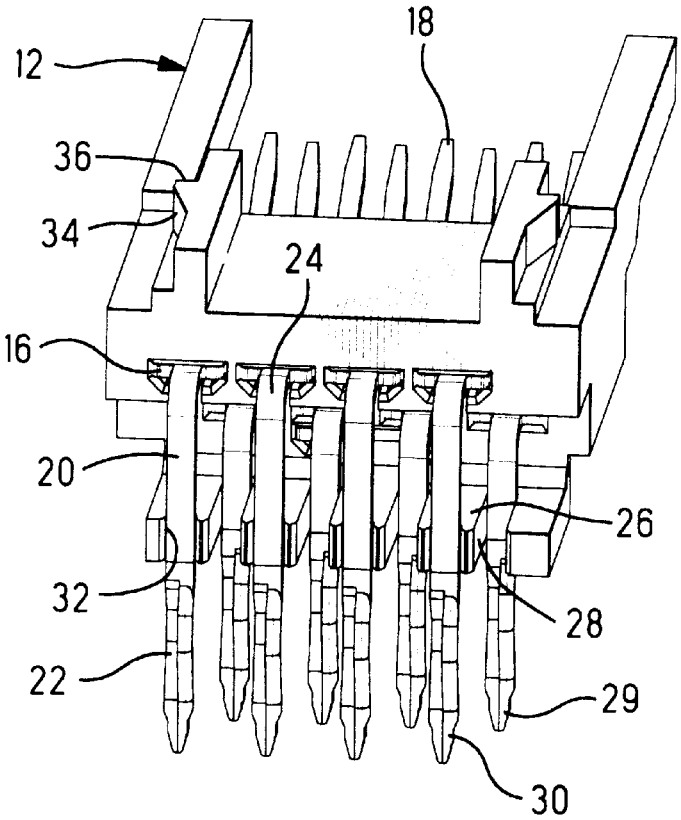
FIG. 5 is a rear isometric view of the lower terminal insert.

As best seen in FIG. 5, the lower insulative member has a series of support bars 26 and slots 28 between the support bars. The downward sections 20 of the terminals are arranged in two lateral terminal rows 29, 30. The downward sections in the terminal row 29 are disposed in the slots 28, and the downward sections in the terminal row 30 are disposed in notches 32 in the ends of the support bars 26. The slots 28 and the notches 32 help to align, stabilize and support the downward sections of the terminals which are exposed at the rear of the lower insulative member. Further stabilization and support for the exposed portions of the terminals is provided by the upper terminal insert 40 as will be described.

Referring back to FIGS. 1 and 3, the upper terminal insert 40 includes an upper insulative member 42 and a plurality of terminals 44. Each of the terminals has a vertically extending retention section 46 (shown in FIGS. 11 and 12) which is secured in the upper insulative member. Each of the terminals extends horizontally to a forward mating section 48 which is engageable with a terminal of a mating modular plug. An opposite end of each terminal includes a compliant pin lead 52 for electrical and mechanical engagement with a circuit board.

Figure 6:
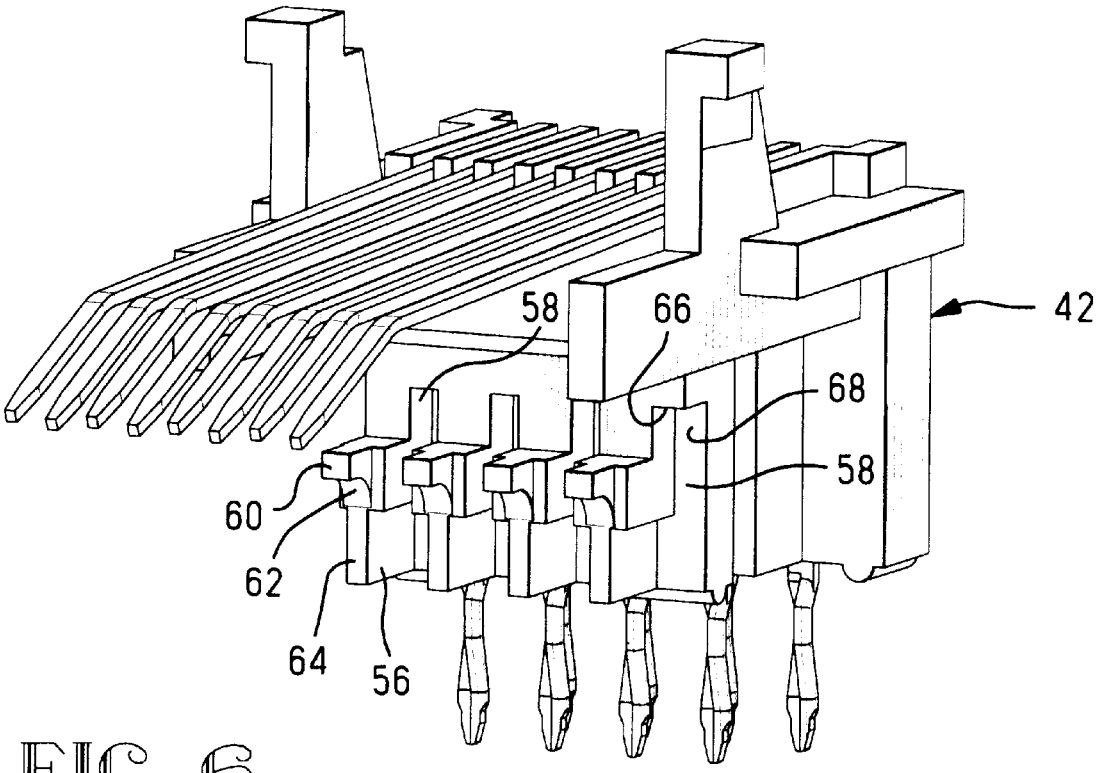
FIG. 6 is a front isometric view of the upper terminal insert.

A forward portion of the upper insulative member provides support surfaces which are configured to confront the exposed portions of the terminals at the rear of the lower terminal insert. As best seen in FIG. 6, the upper insulative member has an array of forwardly extending ribs 56 and inwardly extending grooves 58. The ribs 56 are configured to fit in the slots 28 between the support bars 26 of the lower insulative member. Extending from each rib 56 is a projection 60 having a curvilinear undersurface 62 which transitions to a front surface 64 of the rib 56. The undersurfaces 62 and the front surfaces 64 are configured to closely confront the exposed portions of the terminals in the terminal row 29. In this way, the undersurfaces 62 and the front surfaces 64 serve as support surfaces for the exposed portions of the terminals in the terminal row 29 when the compliant pin leads 22 of these terminals are installed in a circuit board. Further, the exposed portions of the terminals in the terminal rosy 30 are received in the grooves 58. A downwardly facing surface 66 and a forwardly facing surface 68 within each of the grooves serve as support surfaces for the exposed portions of the terminals in the terminal row 30.

Figure 7:
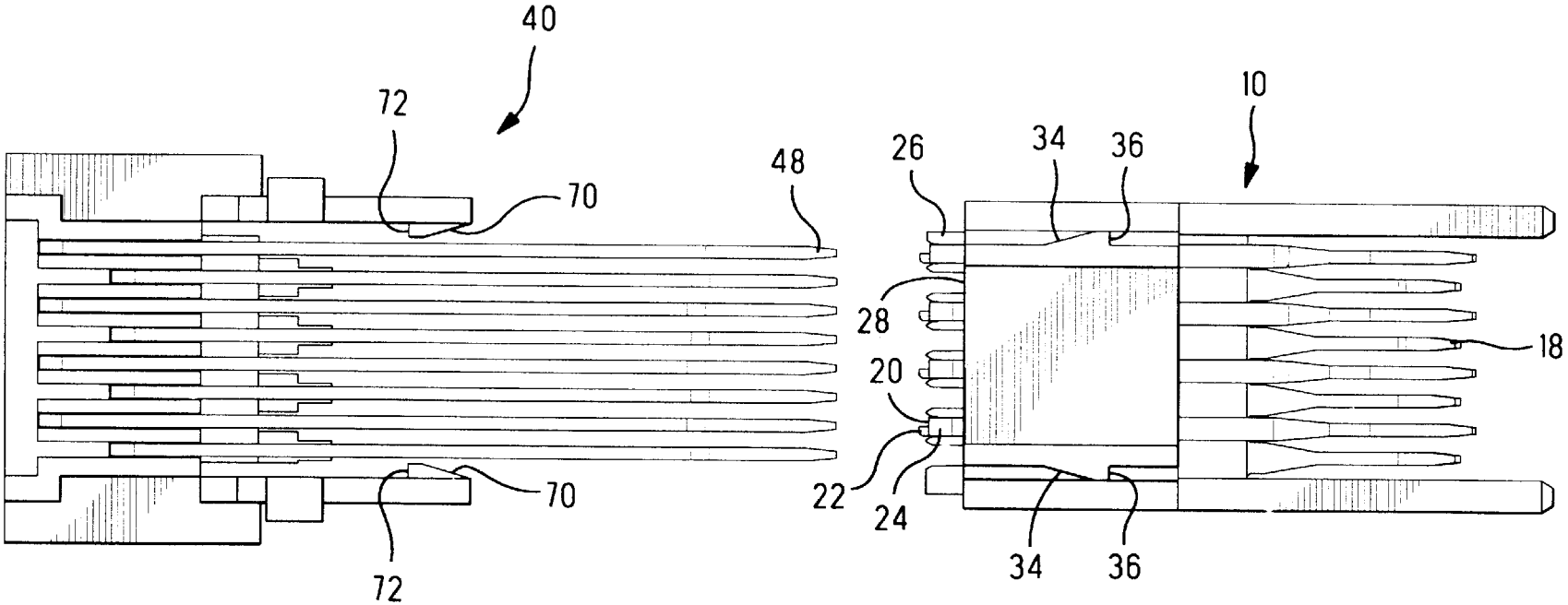
FIG. 7 is a top plan view of the upper and lower terminal inserts.
Figure 8:
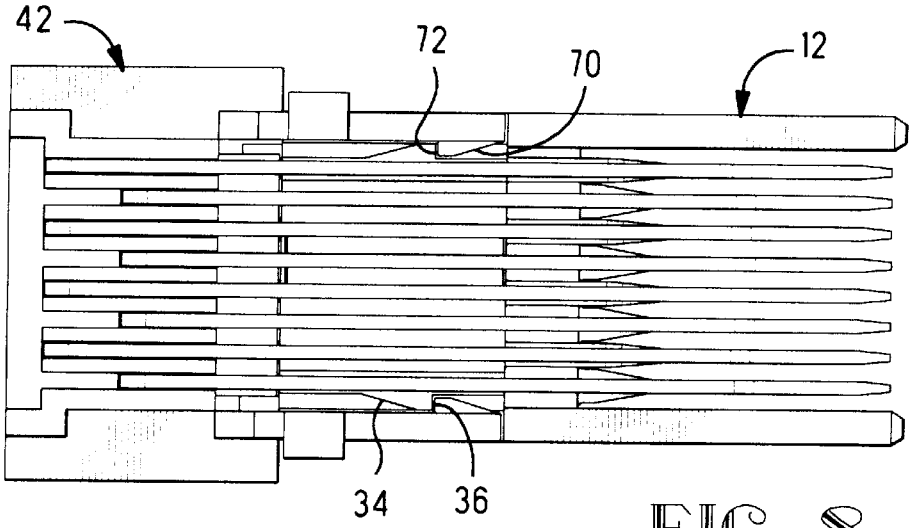
FIG. 8 is a top plan view of the terminal insert subassembly.
Figure 9:
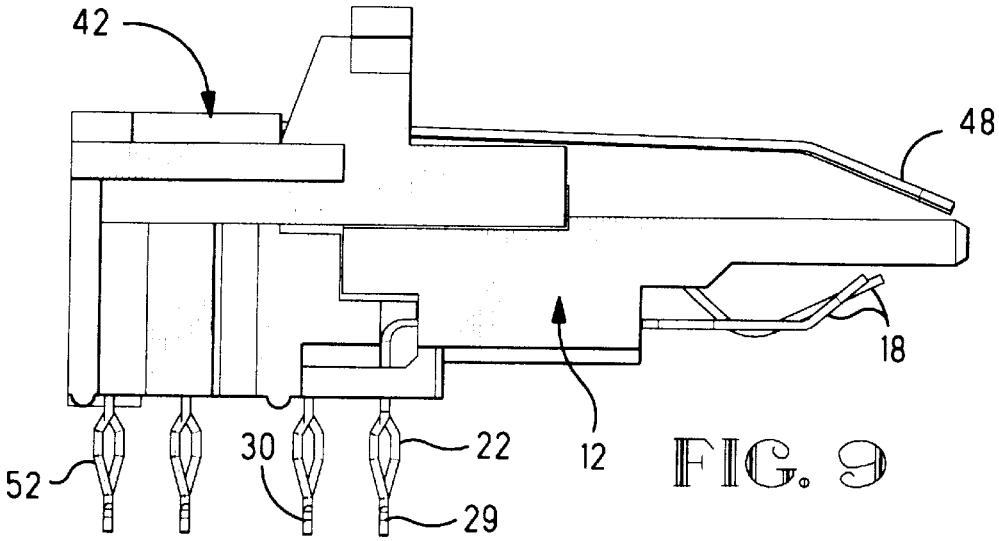
FIG. 9 is a side view of the terminal insert subassembly.
Figure 10:
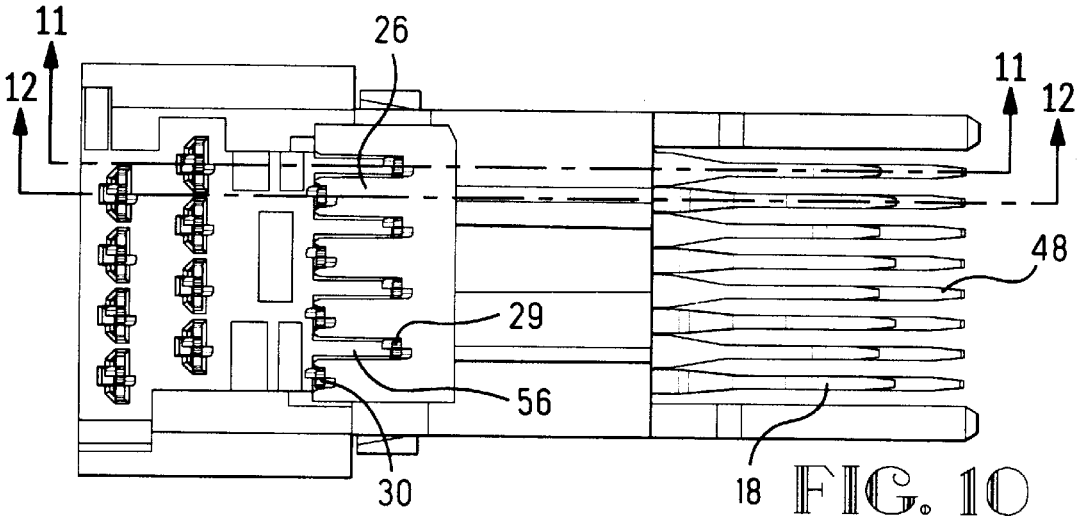
FIG. 10 is a bottom view of the terminal insert subassembly.

Referring now to FIGS. 7 and 8, the upper terminal insert 40 has ramps 70 and rearwardly facing latches 72. The lower terminal insert 10 has ramps 34 and forwardly facing latches 36. The latches 36 and 72 cooperate to secure the upper and lower terminal inserts together in a latched condition.

Figure 11:
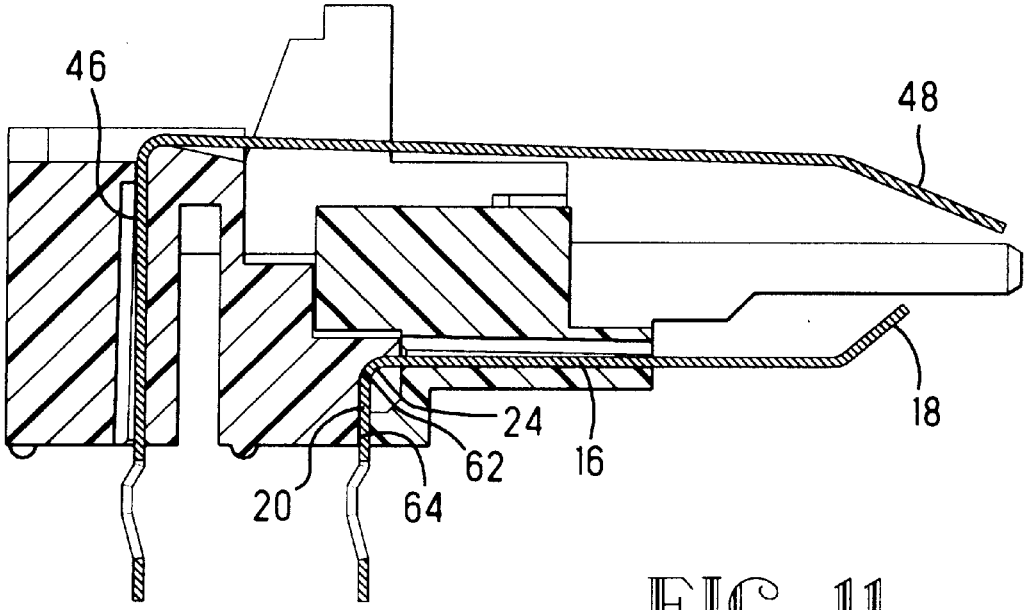
FIG. 11 is a cross-sectional view taken along line 11—11 in FIG. 10.
Figure 12:
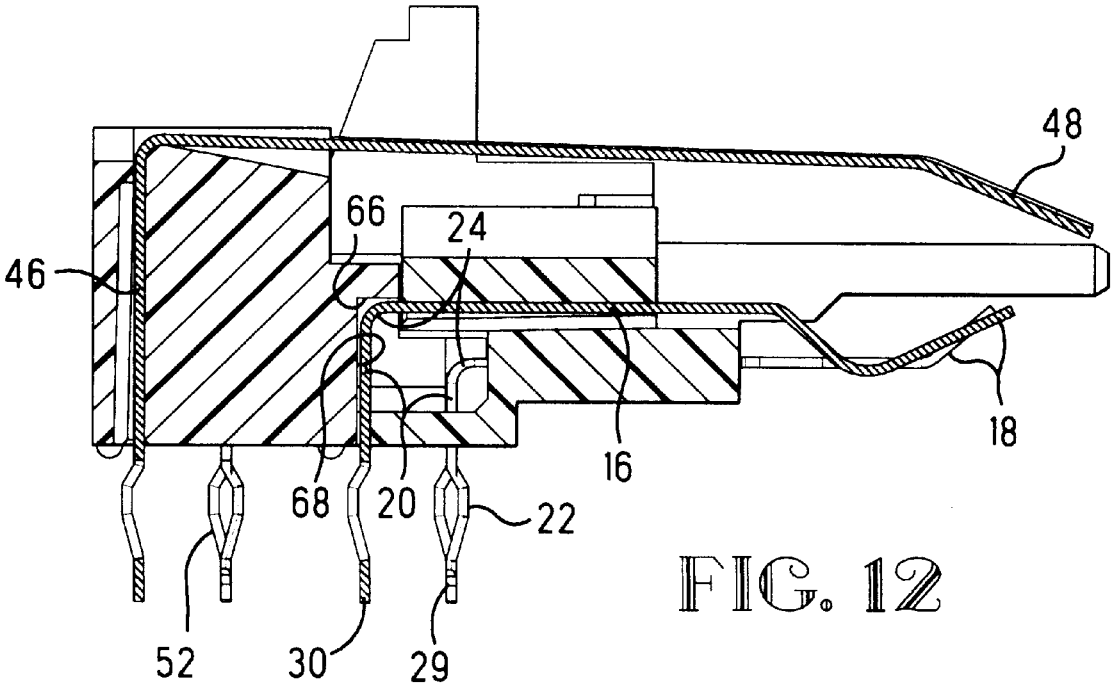
FIG. 12 is a cross-sectional view taken along line 12—12 in FIG. 10.

As shown in FIGS. 11 and 12, when the upper and lower terminal inserts are latched together, the support surfaces 62, 64, 66, 68 closely confront the bend sections 24 and the downward sections 26 which are exposed at the rear of the lower terminal insert. The support surfaces 62, 64, 66, 68 may either be in contact with the exposed portions of the terminals or spaced from the exposed portions by a small clearance. If the support surfaces are spaced from the exposed portions, the exposed portions will be deflected into engagement with the support surfaces during insertion of the compliant pins into holes in a circuit board. The support surfaces provide support and stability for the exposed portions of the terminals when the compliant pins are urged into the circuit board holes.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An insert subassembly for an electrical connector comprising:

a lower terminal insert including a lower insulative member which carries a plurality of terminals which have exposed portions at a rear of the lower insulative member, the exposed portions extending downwardly to define leads for the connector; and an upper terminal insert including a plurality of terminals and upper insulative member having support surfaces which confront the exposed portions of the terminals of the lower terminal insert, when said lower terminal insert and said upper terminal insert are latched together, to provide support for the exposed portions when the leads are engaged with a circuit board.

2. The insert subassembly of claim 1 wherein the upper insulative member includes forwardly extending ribs, and the support surfaces are at least partially defined by front surfaces of the forwardly extending ribs.

3. The insert subassembly of claim 1 wherein the upper insulative member includes forwardly extending projections, and the support surfaces are at least partially defined by undersurfaces of the forwardly extending projections.

4. The insert subassembly of claim 1 wherein the upper insulative member includes grooves between forwardly extending ribs, and the support surfaces are at least partially defined by a wall surface within each of the slots.

5. The insert subassembly of claim 1 wherein the lower terminal insert and the upper terminal insert have mutually cooperable latches.

* * * * *